US007926150B2

(12) United States Patent
Robert et al.

(10) Patent No.: US 7,926,150 B2
(45) Date of Patent: Apr. 19, 2011

(54) BRACELET CLASP WITH LENGTH-ADJUSTMENT DEVICE

(75) Inventors: Christophe Robert, Le Locle (CH); Murat Gorgulu, Morteau (FR)

(73) Assignee: LVMH Swiss Manufactures SA, La Chaux-De Fonds (CH)

( * ) Notice: Subject to any disclaimer, the term of this patent is extended or adjusted under 35 U.S.C. 154(b) by 49 days.

(21) Appl. No.: 12/474,677

(22) Filed: May 29, 2009

(65) Prior Publication Data

US 2009/0241597 A1 Oct. 1, 2009

Related U.S. Application Data

(63) Continuation of application No. PCT/EP2007/058548, filed on Aug. 17, 2007.

(30) Foreign Application Priority Data

Dec. 1, 2006 (CH) ..... 1961/06

(51) Int. Cl.
*A44C 5/16* (2006.01)
*A44C 5/24* (2006.01)

(52) U.S. Cl. ..... 24/71 J; 24/70 J; 24/265 WS

(58) Field of Classification Search ..... 24/70 J, 24/70 ST, 69 ST, 69 J, 71 R, 71 ST, 71 J, 24/68 J, 265 WS
See application file for complete search history.

(56) References Cited

U.S. PATENT DOCUMENTS

| | | | | |
|---|---|---|---|---|
| 3,643,295 | A * | 2/1972 | Schoch | 24/70 SK |
| 4,977,614 | A | 12/1990 | Kurcbart | |
| 7,412,755 | B2 * | 8/2008 | Tetu et al. | 24/71 J |
| 2005/0237864 | A1 | 10/2005 | Albisetti | |

FOREIGN PATENT DOCUMENTS

| | | | |
|---|---|---|---|
| AT | 360258 | B | 12/1980 |
| CH | 669501 | A5 | 3/1989 |
| DE | 203360 | | 10/1907 |
| DE | 267359 | | 11/1912 |
| EP | 286561 | A1 * | 10/1988 |
| EP | 1588642 | A1 | 10/2005 |
| EP | 1654950 | A | 5/2006 |
| FR | 427846 | | 6/1911 |
| GB | 2269200 | A * | 2/1994 |
| RU | 2199253 | C2 | 2/2003 |

OTHER PUBLICATIONS

International Search Report dated Nov. 22, 2007.

* cited by examiner

*Primary Examiner* — James R Brittain
(74) *Attorney, Agent, or Firm* — Pearne & Gordon LLP

(57) ABSTRACT

Wristlet clasp allowing the wristlet length to be finely adjusted. A wheel accessible through an opening in the cover can be made to rotate to screw or unscrew a threaded rod so as to move an end of the wristlet relative to the cover.

18 Claims, 4 Drawing Sheets

BRACELET CLASP WITH LENGTH-ADJUSTMENT DEVICE

RELATED APPLICATIONS

The present application is a continuation of international application PCT/EP2007/058548 (WO2008/064931), the content of which is included by reference, and which claims priority of Swiss patent application 1961/06 of Dec. 1, 2006, the contents whereof are included by reference.

TECHNICAL FIELD

The present invention concerns a wristlet clasp, notably a clasp with unfolding buckle for watch wristlet.

STATE OF THE ART

In the prior art, wristlet clasps with unfolding buckles are known that allow the watch to be slipped on easily when the buckle is unfolded and then sufficiently tighten around the wrist when in closed position. Such clasps are notably often used in combination with wristlets formed of rows of metallic links. Adjusting the length of the wristlet is carried out in the jeweler's shop by removing rows of links from the wristlet, so as to adapt it to the wrist.

The adjustment is thus made by a step corresponding to a length of the link. An accurate adjustment in the case of large links is thus not possible. Furthermore, once adjusted, it is difficult to modify it, for example to increase comfort during an effort or when the watch must be worn over clothing or a combination.

One therefore also knows in the prior art devices for finely adjusting the wristlet length. CH669501 describes an indexed mechanism integrated into the clasp. This device allows only an adjustment in increments corresponding to the distance between two notches and requires the clasp to be opened in order to make the adjustment. It would however be desirable to be able to adjust the wristlet length with the clasp folded back, so as to feel immediately the effect of the modification.

AT360258 describes a mechanism for adjusting the length of a wristlet with the aid of a wheel whose action causes the ends of the wristlet to wind around the wheel's rotation axle. This axle is perpendicular to the plane of the wristlet. The device is suitable only for wristlets whose extremity is sufficiently flexible to wind around an axle inside the clasp. The clasp's width must be considerable to accommodate the wound wristlet.

US2005/0237864 describes a device for adjusting the length of a wristlet with the aid of an adjustment wheel that causes one end to slide on rails. This adjustment mechanism is not integrated in a clasp. The wheel's axle is perpendicular to the plane of the wristlet. This solution also requires one end to wind around the axle of the wheel.

Similar solutions using an end wound around the axle of a wheel with an axle perpendicular to the wristlet are also described in DE267359, DE200203360 and FR427846.

U.S. Pat. No. 4,977,614 describes a device for adjusting the length of an indexed wristlet with the aid of a small adjusting wheel close to the case. The axle of the small wheel is parallel to the plane of the wristlet. This solution requires a wristlet whose upper surface is provided with notches.

EP1588642 describes a wristlet clasp with unfolding buckle using a wheel whose axle is once again perpendicular to the plane of the wristlet. A toothed wheel is mounted on the axle of the wheel in order to engage two racks under the clasp's cover. This solution is complex and requires a very wide clasp to accommodate the toothed wheel and both racks under the cover.

Generally speaking, use of a wheel with an axle perpendicular to the plane of the wristlet is not advantageous; the wheel must in fact protrude sufficiently above the clasp to be operated easily by its periphery. The wheel thus adds a considerable thickness to the clasp, which is rather uncomfortable when the wrist is placed on a table or in the sleeve of an item of clothing for example.

BRIEF SUMMARY OF THE INVENTION

One aim of the invention is to propose a wristlet clasp allowing the wristlet length to be finely adjusted and free of the limitations of known clasps.

Another aim of the invention is to propose a clasp that is easy to manufacture, reliable, easy to operate and comfortable to wear.

Another aim is to allow sufficient adjustment range, for example close to the length of a half-link.

According to the invention, these aims are achieved notably by means of a wristlet clasp designed to assemble a first and a second end of a wristlet to open or increase the wristlet, having a threaded rod parallel to the plane of the wristlet. The threaded rod is connected to a first mobile end of the wristlet. A wheel whose longitudinal position is fixed relative to the second end of the wristlet can be turned so as to screw or unscrew the rod in the wheel or in the first end, so as to move the first end relative to the wheel.

This solution has notably the advantage over the prior art to allow a continuous adjustment of the wristlet length over a considerable range.

Use of a wheel with an axle perpendicular to the plane of the wristlet further allows the width of the protruding portion to be reduced; the wheel can, in fact, be operated easily by its lateral sides even if the greatest part of the wheel is under the cover.

BRIEF DESCRIPTION OF THE DRAWINGS

Examples of embodiments of the invention are indicated in the description illustrated by the attached figures in which.

EXAMPLES OF EMBODIMENT(S) OF THE INVENTION

Figure 1:
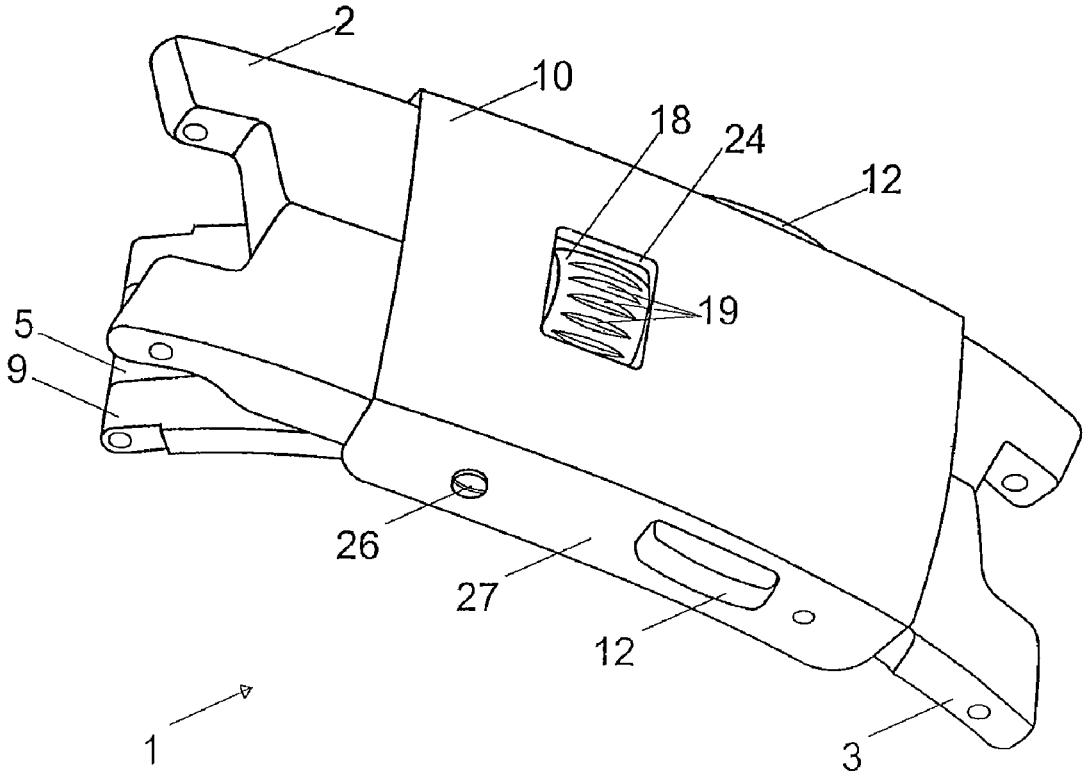
FIG. 1 is a perspective view of a folded back clasp according to the invention.

In the following description and claims, one will refer to the "wristlet plane" as being the plane defined by the lower sides of the wristlet, or the plane on which the open wristlet could be placed flat with the watch dial facing upwards. The longitudinal direction of the wristlet is defined in the wristlet plane as the wristlet's maximum elongation direction. The transversal direction is perpendicular to the longitudinal direction in the wristlet plane; it is generally the direction of the pins connecting the wristlet links to one another. The lower side of the wristlet or of the clasp is the side directed towards the wrist when the wristlet is worn; the outer side is opposed to the lower side.

The wristlet clasp illustrated in FIGS. 1 to 4 comprises a metallic cover 10 that closes above unfolding blades 5, 8. In this example, the cover is formed form a metallic plate of uniform width that is die-stamped and then folded. Covers machined from a solid block, without any folding step, are also conceivable. The unfolding blades illustrated comprise a central blade 5 that is lodged in folded back position in a space between the two shanks of a chassis 8. The blade 5 and the chassis 8 occupy a single thickness in the folded back position as in FIG. 4. Other constructions of folding blades, including clasps of the butterfly type, can be used within the frame of the invention.

The clasp can be locked with the aid of a push-button mechanism 12 described in application WO2006079605 in the applicant's name. The push-buttons 12 can be pushed back against the action of springs, not represented, to move mushroom shaped stoppers 14 in a transversal direction. In the resting position illustrated in FIG. 4, the stoppers 14 are pushed back by the springs towards the outside of each side of the clasp, so as to prevent deployment of the shanks of the chassis 8 whose edge of the cut-outs is held by the head of the stoppers 15. In order to open the clasp, it is necessary to press on the push-buttons 12 in order to move the two stoppers 14 towards the openings 16 on the side of the central blade 5, whose diameter is sufficient for letting the stopper heads to pass and the blades to unfold.

The central blade 5 is connected in an articulated fashion with the cover 10 through an axle 13. The chassis 8 is also connected in an articulated manner with a second end of the wristlet 3 or to a connecting part with this second end.

The first end of the wristlet 2 is connected to the clasp by a mechanism allowing it to slide longitudinally so as to adjust the wristlet length. According to the invention, this mechanism comprises a wheel 18 mounted on a threaded rod 20. It is enough for at least a portion of the outer sides of the rod 20 to be threaded. The axle of the wheel and the axis of the rod are both parallel to the wristlet's longitudinal axis. A portion of the lateral side of the wheel 18 traverses a rectangular opening 24 on the upper side 29 of the cover 10 so as to allow the wheel to be operated without opening the clasp. In order to increase comfort, the wheel protrudes by a few millimeters at most above the side 29. The greatest part of the wheel's volume is thus permanently under the surface of the cover. The lateral sides of the wheel are provided with a grooved and/or ribbed profile 19 in order to make it easier to grasp it.

Figure 3:
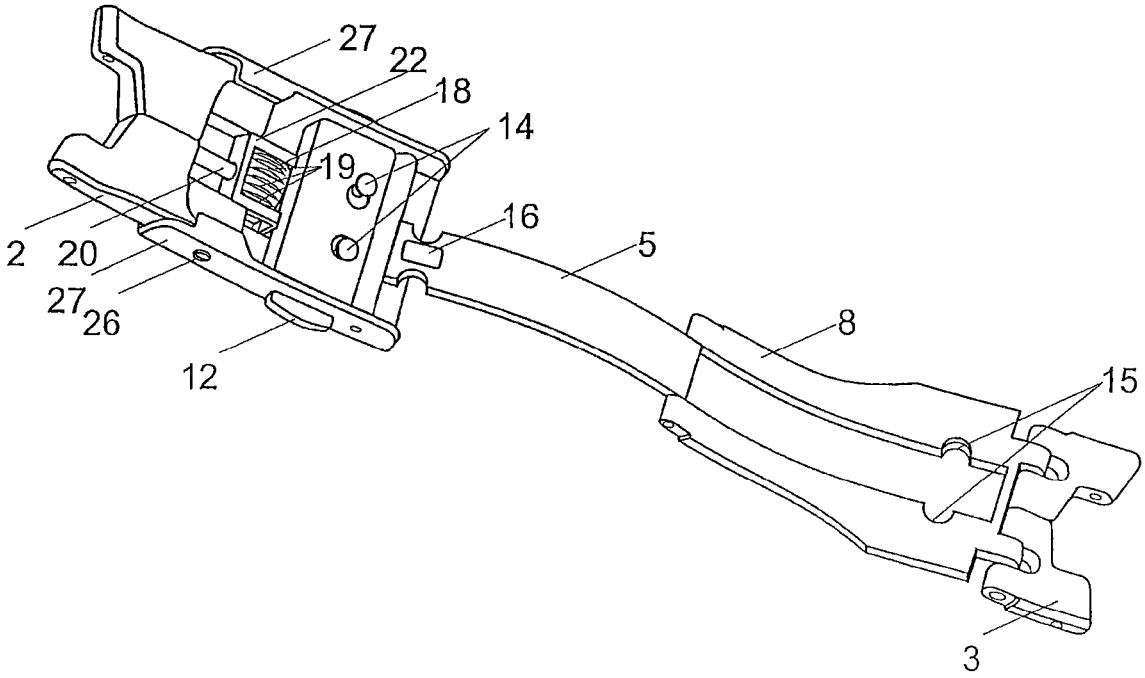
FIG. 3 is a perspective view of an open clasp according to the invention, seen from below, the wheel being at a second extremity of the adjustment range.

The threaded rod 12 and the wheel 18 are connected to the inner side of the cover in this embodiment by a bow 22 visible in particular in FIG. 3. The bow comprises two transverse flanks on each part of the wheel, that are traversed by the rod 20 with sufficient play to allow it to pivot and/or slide. Both flanks are connected to one another by arches parallel to the cover, and against which the chassis 8 stops when the clasp is folded. One avoids thus a pressure of the clasp's blades 5, 8 against the wheel 18. Other equivalent stopper elements can be provided to limit the movement of the blades 5, 8 against the inner side of the cover.

In a first embodiment of the invention, the threaded rod 20 is engaged in a bored hole, not illustrated, inside the wheel 18, so that the rotation of the wheel causes the screwing or unscrewing of the rod in the wheel 18 and an axial displacement of the rod that drives the first end 2. In one embodiment, the threaded rod 20 is fixedly united with the wheel 18 and turns with it; the other extremity of this rod is engaged in a bored hole in the end 2 that moves longitudinally when the rod turns with the wheel. This variant allows an easier assembly of the clasp.

Figure 2:
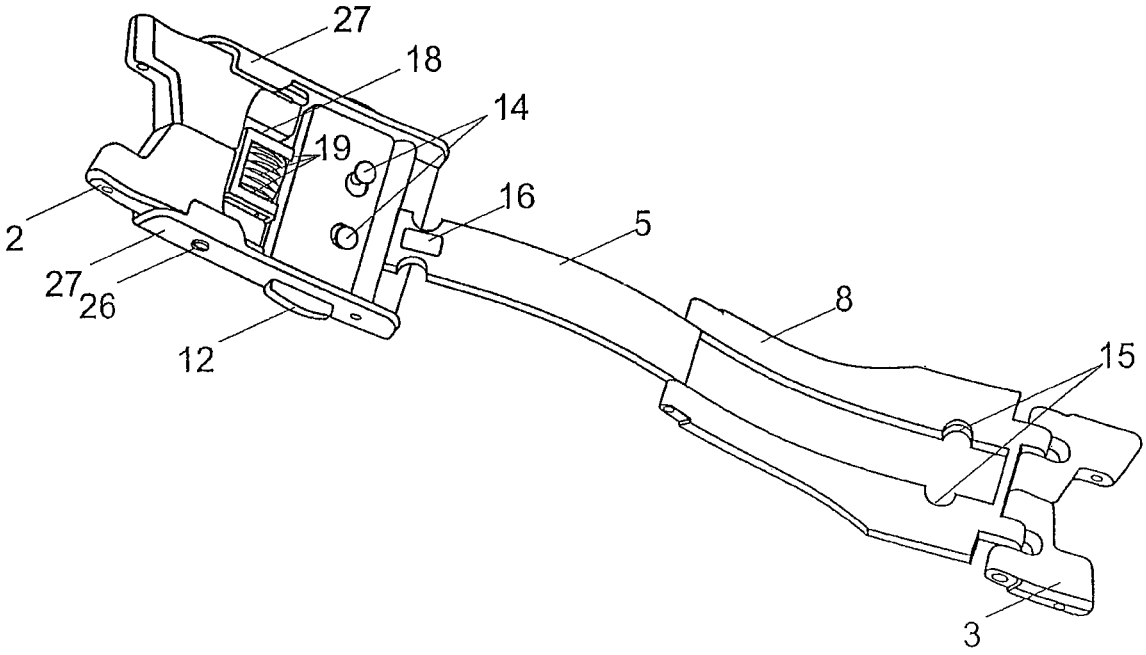
FIG. 2 is a perspective view of an open clasp according to the invention, seen from below, with the wheel being at a first extremity of the adjustment range.

The extremity of the end 2 is guided during its longitudinal movement by the inner sides of the cover 10. More precisely, the end is guided laterally between the lateral sides 27 and upwards between the upper side 29 and the folded back portions 28 defining a beginning of lower side. Screws or pins 26 traverse the lateral sides 27 of the cover and come to engage in oblong openings, not illustrated, on each of the two lateral sides of the end 2, so as to limit the run of the end 2 and to prevent for example that it comes out completely from the cover. Two extreme longitudinal positions are illustrated in FIGS. 2 and 3. Holding the adjusted longitudinal position is ensured by a considerable friction coefficient of the threaded rod with the corresponding threading in the wheel or the end. Additional locking elements, including a push-button, a screw or any appropriate organ, can be provided to prevent an accidental loss of the adjusted position. In a preferred embodiment, a ring gasket, not represented, on both longitudinal sides of the wheel 18 rubs against the two transverse flanks of the bow 22 and possibly against the edge of the cover to increase the torque necessary for operating the wheel.

Figure 4:
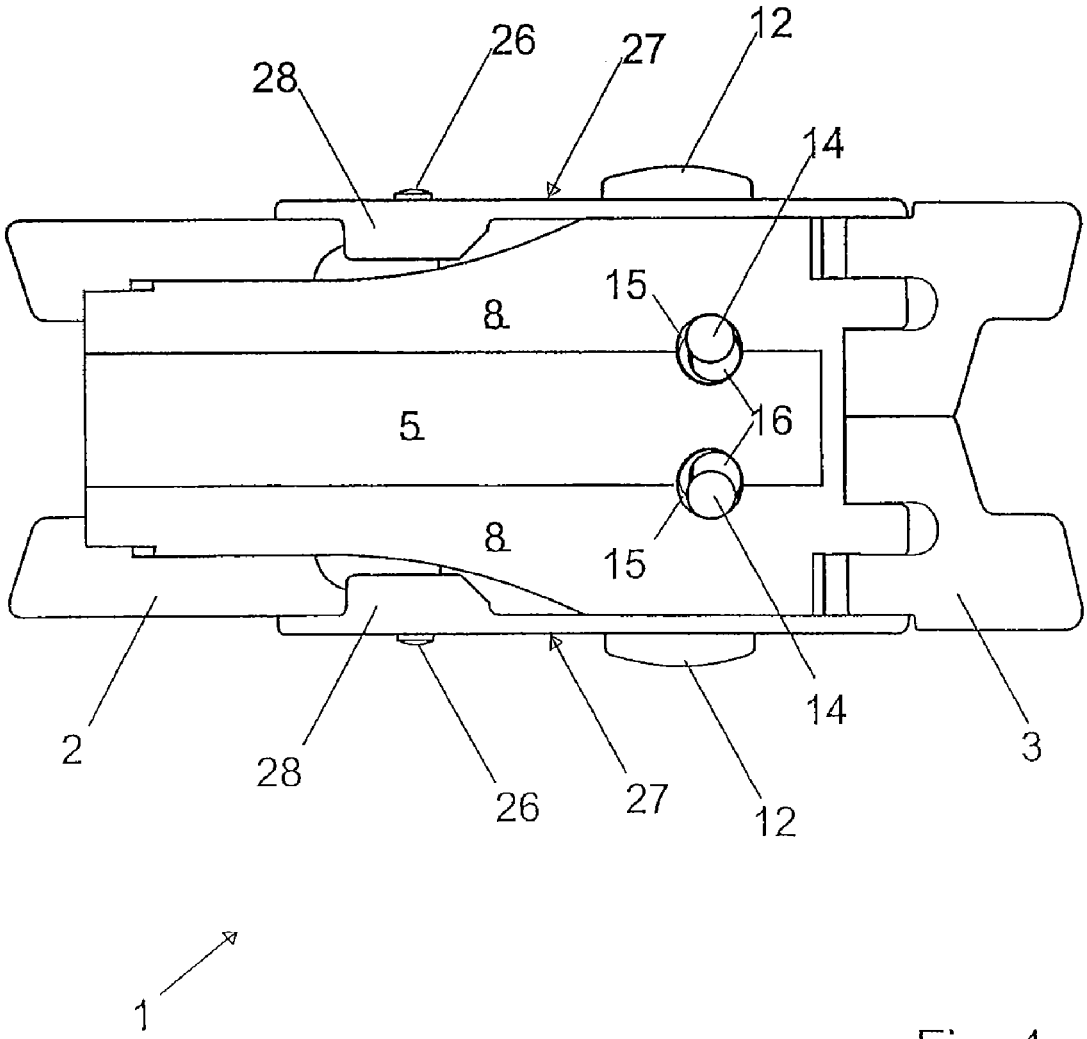
FIG. 4 is a view from below of a folded back clasp according to the invention.

In the folded position illustrated notably in FIG. 4, the blades 5, 8 of the clasp largely hide the rod and the portion of the wheel under the cover so that they are thus widely protected from dust, sand and perspiration.

REFERENCE NUMBERS USED IN THE FIGURES

1 Clasp
2 First end of the wristlet
3 Second end of the wristlet
5 Foldable blades: central blade
8 Foldable blade: chassis
10 Cover
12 Push-button
13 Fastening axle of the end 5 to the cover
14 Mobile stopper
15 Openings in the chassis
16 Openings in the central end
18 Wheel
19 Ribbed profile of the wheel
20 Threaded rod
22 Bow
24 Opening through the cover
26 Guiding rod of the first end
27 Lateral sides of the cover
28 Guiding portions under the cover
29 Upper side of the cover

The invention claimed is:

1. Wristlet clasp provided with a cover and designed to assemble a first and a second end of a wristlet to open or increase the wristlet, with the clasp comprising a wheel whose longitudinal position is fixed relative to the cover, where the rotation of the wheel allows the wristlet length to be adjusted, characterized by:

a threaded rod parallel to the plane of the wristlet, with the threaded rod being connected to a first end of the wristlet, the rotation of the wheel causing a screwing respectively unscrewing of the threaded rod so as to move said first end relative to the cover, the cover covering said threaded rod, and said threaded rod being connected to a wristlet link sliding under said cover.

2. The clasp of claim 1, wherein said wheel comprises a bored hole, said threaded rod being engaged in said bored hole so that the rotation of the wheel causes the screwing respectively unscrewing of said rod in said wheel.

3. The clasp of claim 1, wherein said threaded rod is fixedly united with said wheel, with said rod being engaged in a bored hole of said first end, so that the rotation of the wheel with the threaded rod causes the screwing respectively unscrewing of said threaded rod in said bored hole.

4. The clasp of claim 1, wherein said threaded rod (20) is parallel to the wristlet's longitudinal axis.

5. The clasp of claim 1, with said wheel being capable of being actuated when the cover is closed.

6. The clasp of claim 5, with said cover having an opening allowing access to a portion of the outer surface of the wheel to adjust the wristlet length.

7. The clasp of claim 1, where said wheel is held against the inner side of said cover with the aid of at least one bow traversed by said rod.

8. The clasp of claim 1, having unfolding blades that close under said cover in closed position and unfold outside the cover in open position.

9. The clasp of claim 8, said unfolding blades having a central bit closing between the two lateral bits of a chassis, said central bit taking up a single width with said chassis in closed position.

10. The clasp of claim 8, with said threaded rod being hidden in a space between said cover and said unfolding blades when the cover is closed.

11. The clasp of claim 8, having at least one push-button for releasing said unfolding blades and allowing the clasp to open.

12. The clasp of claim 1, where said link is guided between the upper side of the cover and guiding portions of the cover under said link.

13. The clasp of claim 12, with said cover being formed by folding and die stamping from a sheet of uniform thickness.

14. The clasp of claim 1, where the greatest part of said wheel is accommodated under the cover.

15. Wristlet clasp provided with a cover and designed to assemble a first and a second end of a wristlet to open or increase the wristlet, with the clasp comprising a wheel whose longitudinal position is fixed relative to the cover, where the rotation of the wheel allows the wristlet length to be adjusted, characterized by:

a threaded rod parallel to the plane of the wristlet, with the threaded rod being connected to a first end of the wristlet, the rotation of the wheel causing a screwing respectively unscrewing of the threaded rod so as to move said first end relative to the cover, the cover covering said threaded rod, and the clasp having unfolding blades that close under said cover in closed position and unfold outside the cover in open position.

16. The clasp of claim 15, said unfolding blades having a central bit closing between the two lateral bits of a chassis, said central bit taking up a single width with said chassis in closed position.

17. The clasp of claim 15, with said threaded rod being hidden in a space between said cover and said unfolding blades when the cover is closed.

18. The clasp of claim 15, having at least one push-button for releasing said unfolding blades and allowing the clasp to open.

* * * * *